US005203113A

United States Patent [19]

Yagi

[11] Patent Number: 5,203,113

[45] Date of Patent: Apr. 20, 1993

[54] WINDOW OPENER

[75] Inventor: Mikiya Yagi, Takarazuka, Japan

[73] Assignee: Nippon Cable System Inc., Hyogo, Japan

[21] Appl. No.: 851,547

[22] Filed: Mar. 13, 1992

[30] Foreign Application Priority Data

Sep. 25, 1991 [JP] Japan ..... 3-246188

[51] Int. Cl.[5] ..... E05F 11/00

[52] U.S. Cl. ..... 49/324; 49/340; 49/357

[58] Field of Search ..... 49/340, 324, 357, 337; 296/146

[56] References Cited

U.S. PATENT DOCUMENTS 4,186,524 2/1980 Pelchat ..... 49/357 X
4,249,771 2/1981 Gergoe et al. ..... 49/357 X
4,918,865 4/1990 Hirai ..... 49/357 X

FOREIGN PATENT DOCUMENTS 2195392 4/1988 United Kingdom ..... 49/340

*Primary Examiner*—Philip C. Kannan
*Attorney, Agent, or Firm*—Armstrong, Westerman, Hattori, McLeland & Naughton

[57] ABSTRACT

A window opener composed of a motor retained in a casing, a damper for vibration isolation suitable interposed between the motor and the casing, a worm and a worm wheel which are concentrically connected to an output shaft of the motor, and pinion which is concentrically projected from the worm wheel, an output gear engaged with the pinion, a shaft projected from an upper surface of the output gear and a link mechanism for transforming a rotational force in one direction of the shaft into an opening force and transforming the rotational force in another direction of the shaft into a closing force of the window; being characterized in that the worm and worm wheel and the output gear are arranged in such a manner as to be superposed.

4 Claims, 7 Drawing Sheets

WINDOW OPENER

BACKGROUND OF THE INVENTION

The present invention relates to a window opener (hereinafter referred to as an opener) and more particularly to an opener for opening or closing a rear window (a quarter window) of a two-door sedan by means of motor operation.

There has hitherto been known a window opener as disclosed in Japanese Unexamined Patent Publication No. 66387/1989.

As shown in FIG. 7 of the drawings herein the known opener 51 comprises an operation device 52 fixed by a window frame F (including a rear puller and a ceiling) and an actuating device 54 for driving the operation device 52. The actuating device 54 is provided in a location separated from the operating device and fixed on a body panel 53. A pair of pull cables 55*a* and 55*b* for transmitting a driving force is arranged between the actuating device 54 and the operation device 52. A rotary shaft 56, which is integrated into the operating device 52, is provided with a link mechanism 57. When one of the above cables 55*a* and 55*b* (for instance the cable 55*a*) is pulled, the rotary shaft 56 is rotated in one direction. Therefore, a window W is opened by means of the link mechanism. When another cable (for instance the cable 55*b*) is pulled, the rotary shaft 56 is rotated in another direction. Therefore, the window W is closed.

In the above conventional opener 51, the actuating device 54 is arranged in such a manner that the actuating device 54 is separated from the operation device 52 and cables 55*a* and 55*b* should be installed. Therefore, there are such problems in the conventional opener that the opener requires many parts, the total cost of producing the opener is too much and a space for locating the opener is large. Further, there has been a limitation in a radius of curvature of the cable and a length of the cable so that the freedom for arranging the opener is low.

Since the conventional opener requires the cables, driving efficiency of the actuating device is low. As a consequence a motor performing high torque is required so that the cost of the opener increases and the size of the actuating device becomes large.

Furthermore, the size of the conventional actuating device has become large since gears in a reduction device which is connected with an output portion of the motor are normally arranged in the lateral direction. The conventional actuating device further is not provided with a vibration isolating device.

The object of the present invention is to resolve the problems mentioned hereinbefore and provide a compact and cheap window opener wherein the actuating portion and the driving portion are integrally combined with each other, and the above opener can open or close the window directly and is equipped on the window frame.

Recently, quietness in the cabin of automobiles has been required as one of performances of the automobile. Therefore, the other object of the present invention is to provide the above opener which is provided with a simple and cheap vibration isolating mechanism in order to meet the above requirement.

SUMMARY OF THE INVENTION

According to the present invention, there is provided a window opener comprising a motor retained in a casing, a damper for vibration isolation suitably interposed between said motor and said casing, a worm and a worm wheel which are concentrically connected to an output shaft of said motor, and pinion which is concentrically projected from said worm wheel, an output gear engaged with said pinion, a shaft projected from an upper surface of said output gear and a link mechanism for transforming a rotational force in one direction of said shaft into an opening force and transforming said rotational force in another direction of said shaft into a closing force of said window; being characterized in that said worm and worm wheel and said output gear are arranged in such a manner as to be superposed.

The opener can have such a construction as to comprise a bracket, wherein both arm portions extend in the direction substantially perpendicular to the shaft of the motor, is arranged in a neighborhood of an end of the output shaft; each of said arm portions being approximately extending to inner faces of said casing opposed to each other; each of first dampers, which is equipped on tip portion of said arm portion, coming into contact with the above inner faces of said casing; a pair of second dampers having a plate-like-shape, each of which is interposed between said motor and each of inner faces defining a floor and a ceiling; and a third damper composed of a pair of flat springs which are integrated in the casing in such a manner as to contact with a tip portion of said worm and a back side of said motor. Further, the opener preferably has such a construction as to comprise a circular groove which is formed around a periphery of a reverse side of said output gear and partially cylindrical protrusions projected from said floor of the casing; said protrusions being engaged with said groove; a tip portion of said worm being extended to the center of the reverse side of output gear.

Besides, the phrases "upper side of said output gear" and "reverse side of said output gear" mentioned herein are used for convenience sake in order to show one end and another end of the output gear and do not mean actual upper side and reverse side.

Further, the window opener is preferably provided with a circuit breaker for preventing the motor from burning by breaking an electric current to the motor when the motor is constrained due to the application of an external force to the window opener.

In the opener of the present invention, when the motor is rotated, the rotational force is reduced by the worm gear and transmitted to the shaft, the link mechanism opens the window by rotating the shaft and the window is closed when the shaft is reversely rotated.

The motor is retained in such a manner that the dampers are suitably interposed between the casing and the motor. Therefore, noise due to vibration of motor is low and the worm is not restrained by the worm wheel when the opener is operated.

Further, the worm is arranged in such a manner as to be superposed on the output gear. Therefore, the worm wheel is naturally superposed on the output gear.

A reduction device constructed in such a manner is small-sized since each of the gears is not arranged radially as in a conventional reduction gear.

DETAILED DESCRIPTION OF THE INVENTION

Figure 1:
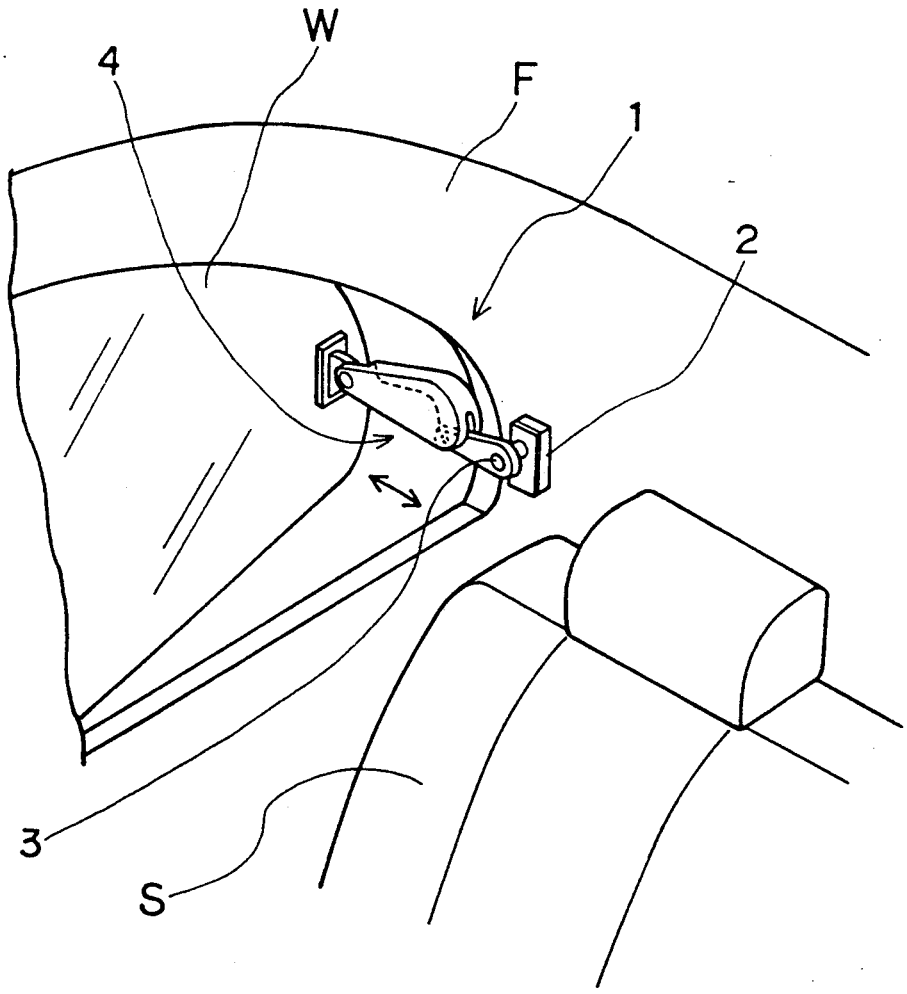
FIG. 1 is a perspective view showing of an embodiment of the present invention.

In FIG. 1, the side of a body located near a rear seat of a two-door sedan is shown. In FIG. 1, the character F denotes a window frame the character W denotes a window, the character S denotes a rear seat. Only the rear side of the window W is shown in FIG. 1. The window frame F is rotatably connected with the window W by a hinge in the fore side which is not shown in FIG. 1 so that the window W can be opened or closed.

In FIG. 1, numeral 1 denotes an opener comprising an actuating device 2 fixed on the window frame F and a link mechanism 4, one end of which is connected with a shaft 3 of the actuating device 2 and the other end of which is fixed on the rear side of the window W.

The length of the link mechanism 4 between both ends thereof extends or shortens by rotating the shaft 3 around an axis thereof due to the actuating device 2. As a result, the window W pivots around the hinge and the rear side of the window W is opened or closed.

Next, the actuating device 2 will be explained.

Figure 2:
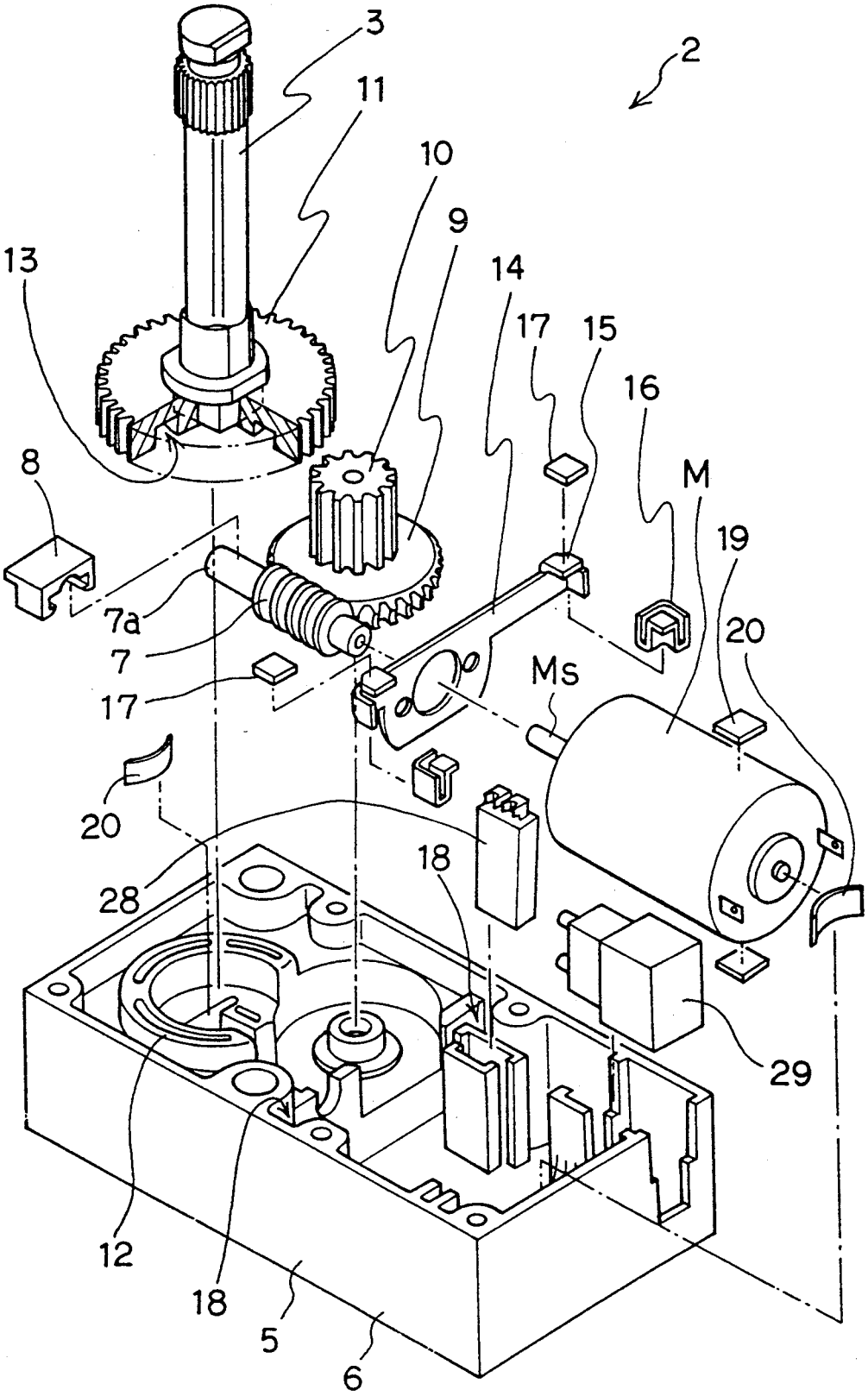
FIG. 2 is an exploded perspective view showing an operation device.

In FIG. 2, numeral 5 denotes a casing comprising a main body 6 and a cover (not shown in Figures). In the casing 5, a motor M is retained. An output shaft Ms of the motor M is connected with a worm 7 in such a manner that one end of the worm 7 is fixed to the output shaft Ms. A tip portion 7*a* of the worm 7 is engaged with a recess portion on a floor of the main body 6 and retained by a holder 8 having a "C"-like-shaped section. A worm wheel 9 which is engaged with the worm 7 is rotatably supported on the floor of the main body 6 and a pinion 10 is formed on an upper side of the worm wheel 9 in such a manner that the pinion 10 concentrically protrudes from the worm wheel 9. An output gear 11 which is engaged with the pinion 10 is rotatably supported by the bearing 12 which projects from the floor of the main body 6. On the upper side of the output gear 11, the output gear 11 is concentrically provided with the shaft 3 which is connected with a link mechanism 4 and rotates together with the output gear 11.

The above bearing 12 retains the output gear 11 in such a manner that the output gear engages with a circular groove 13 which is concentrically formed in the reverse side of the output gear 11. As a result, the worm 7 can be extended to approximately to the center of the reverse side of the output gear 11. Then, the output gear 11, the worm 7 and worm wheel 9 can be arranged in such a manner as to be superposed as shown in FIG. 3.

The worm 7, the worm wheel 9, the pinion 10 and the output gear 11 are superposed on each other. Therefore, the construction of a compact reduction gear can be abtained.

Figure 3:
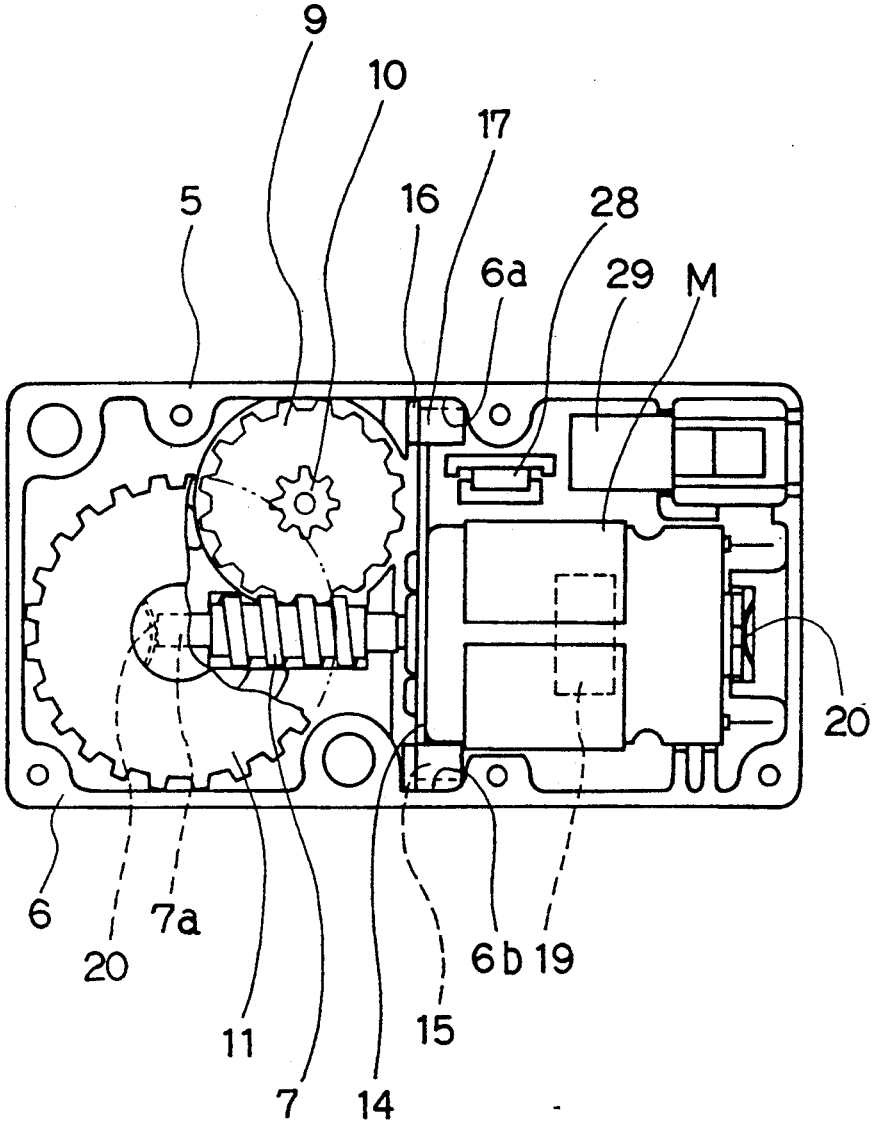
FIG. 3 is a plan view of the operation device of FIG. 2.

Next, the above motor M is retained in the casing in such a manner that several kind of dampers are interposed between the motor M and the casing 5 (with reference to FIGS. 2 to 3). Hereinafter, "left side" and "right side" in FIG. 3 are respectively called "fore side" and "rear side". That is to say, near the output end, the motor M is provided with a bracket 14 extending approximately to both sides 6*a* and 6*b*.

A fixture 15 for fixing the dampers having a reversed "L"-like-shaped section when the fixture 15 is viewed from the rear side is formed in both ends of the bracket 14 (with reference to FIG. 2).

Figure 4:
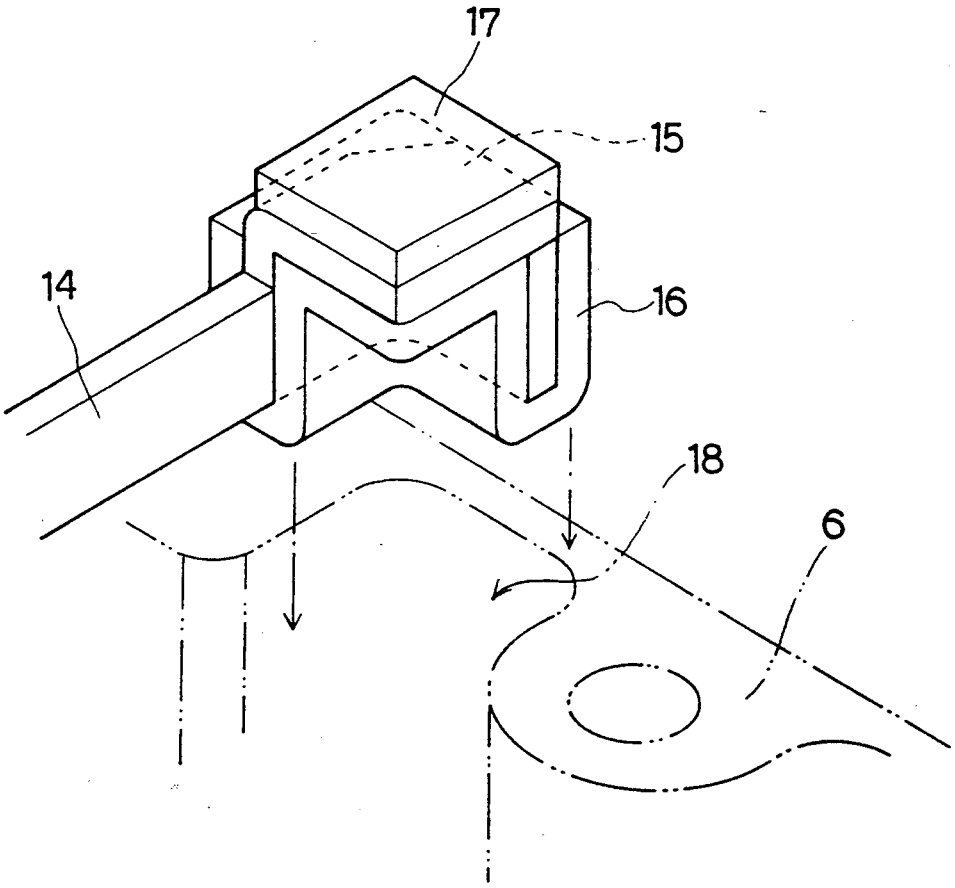
FIG. 4 is a perspective view showing a first damper.

A first damper 16 is engaged with the fixture 15 having a "L"-like-shaped groove for fixing dampers from the lower side thereof (with reference to FIG. 4).

A plate-like-shaped elastic body 17 is placed on the upper side of the fixture 15 for fixing the damper. Then, the fixture 15 for fixing the damper is fixedly engaged with the recess portion for engaging the main body 6 (with reference to FIGS. 2 to 4) so that the cover is pushed by the fixture 15 via the elastic body 17.

As a result, when the motor M is retained in the casing, a damping effect is achieved three-dimensionally in the place between the motor M and the casing 5 via the bracket 14.

Further, a plate-like-shaped second damper 19 is arranged in such a manner that the second damper 19 is interposed between the cover of the casing 5 and the main body 6 in the upper side and lower side of the motor M.

Further, a plate spring 20 having an "arc-like-shape" in section is provided in the rear side of the motor M and in the tip portion 7*a* of the worm in such a manner that the motor is interposed between both plate springs 20 and longitudinally pushed by the plate springs 20. Thus, the motor M is fixed in the casing 5 in such a manner as to cause a damping effect three-dimensionally.

As a result, in both a actuating device 2, the vibration which the motor M receives and a vibration which the motor M causes can be effectively damped when the opener is used. The motor M together with the worm 7 can be slightly moved in the longitudinal direction by the damping effect. Therefore, the worm 7 is not constrained by the worm wheel 9 with each other and smooth operation can be achieved.

Next, the link mechanism will be explained. As a link mechanism 4 of the opener of the present invention, a compact link mechanism is required. If the link mechanism is compact, it is needless to use a particular one. For example, known link mechanism (with reference to FIGS. 5 to 6 herein) disclosed in Japanese Unexamined Patent Publication No. 66387/1989 can be used.

The above link mechanism is composed of a first link 21, a second link 22 and a fixture 23 by which the link mechanism 4 is fixed to a window W. The first link 21 is connected with the above-mentioned shaft 3 in such a manner that a boss 24 formed in one end thereof can rotate together with the shaft 3. The other end of the first link 22 is connected with one end of the second link 22 so that the first link and the second link can rotate with each other. The other end of the second link is connected with the fixture 23 by means of a ball joint 25.

In the second link 22, a rib is formed so that relative rotation between the first link 21 and the second link 22 can be limited over a certain range. The fixture 23 is fixed in the rear side of the window W.

Next, the operation of the opener 1 including the link mechanism 4 will be explained.

When the motor M in the actuating device 2 shown in FIGS. 2 to 3 is rotated, the rotational force is transmitted to the worm 7, the worm wheel 9, the pinion 10, the output gear and the shaft 3 in turn so that the first link 21 located in the tip portion of the shaft rotates.

Figure 5:
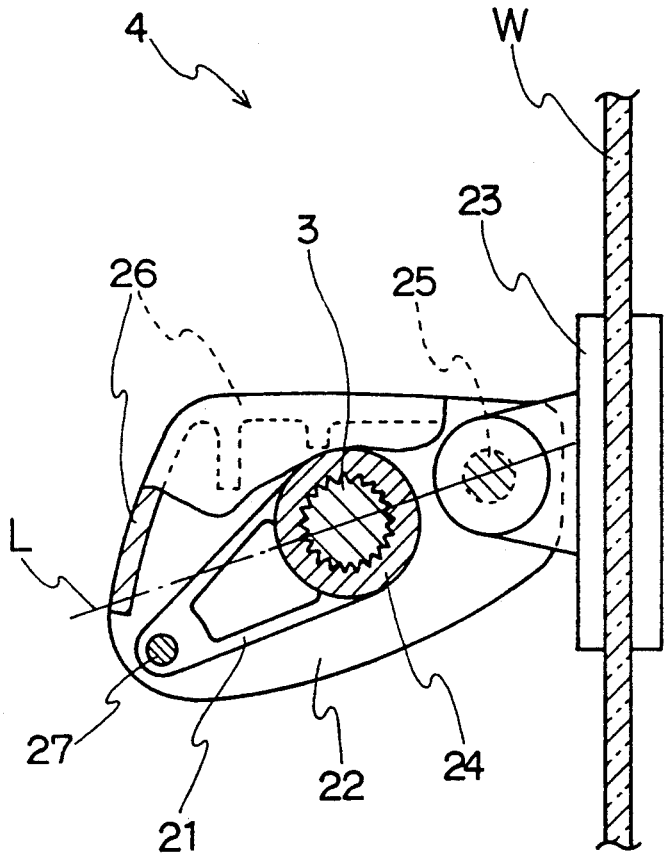
FIG. 5 PRIOR ART
FIG. 5 is an illustrative view of an operation of a link mechanism in FIG. 2 when a window is closed.
Figure 6:
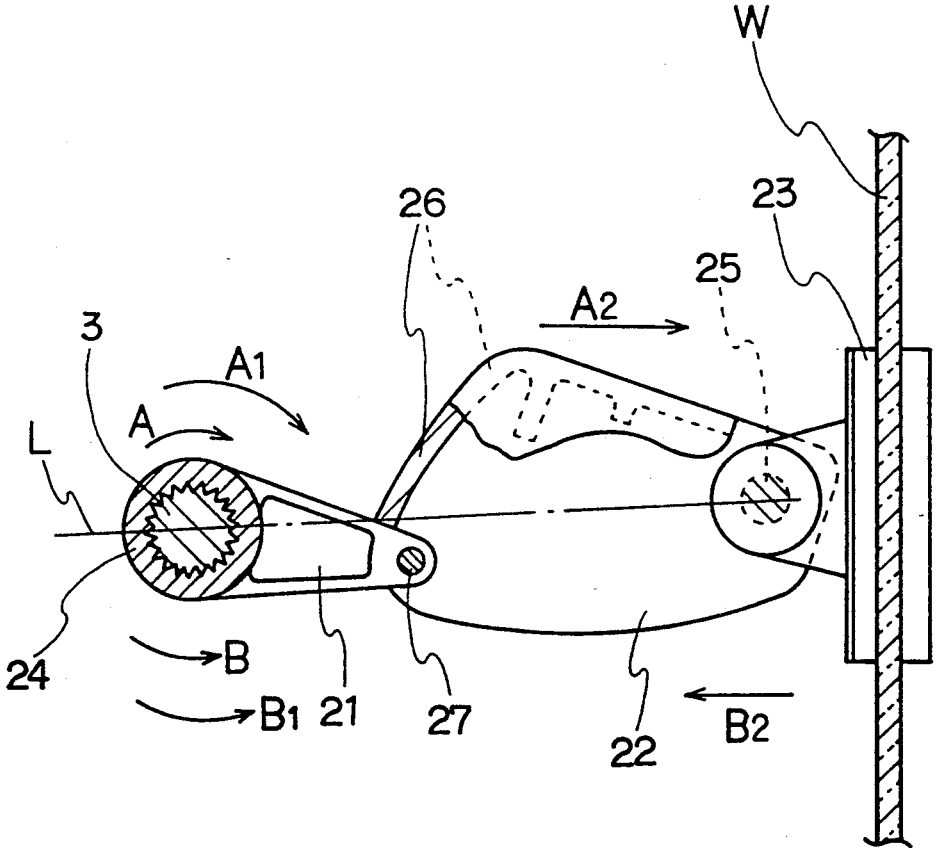
FIG. 6 PRIOR ART
FIG. 6 is an illustrative view of an operation of a link mechanism in FIG. 1 when a window is opened.
Figure 7:
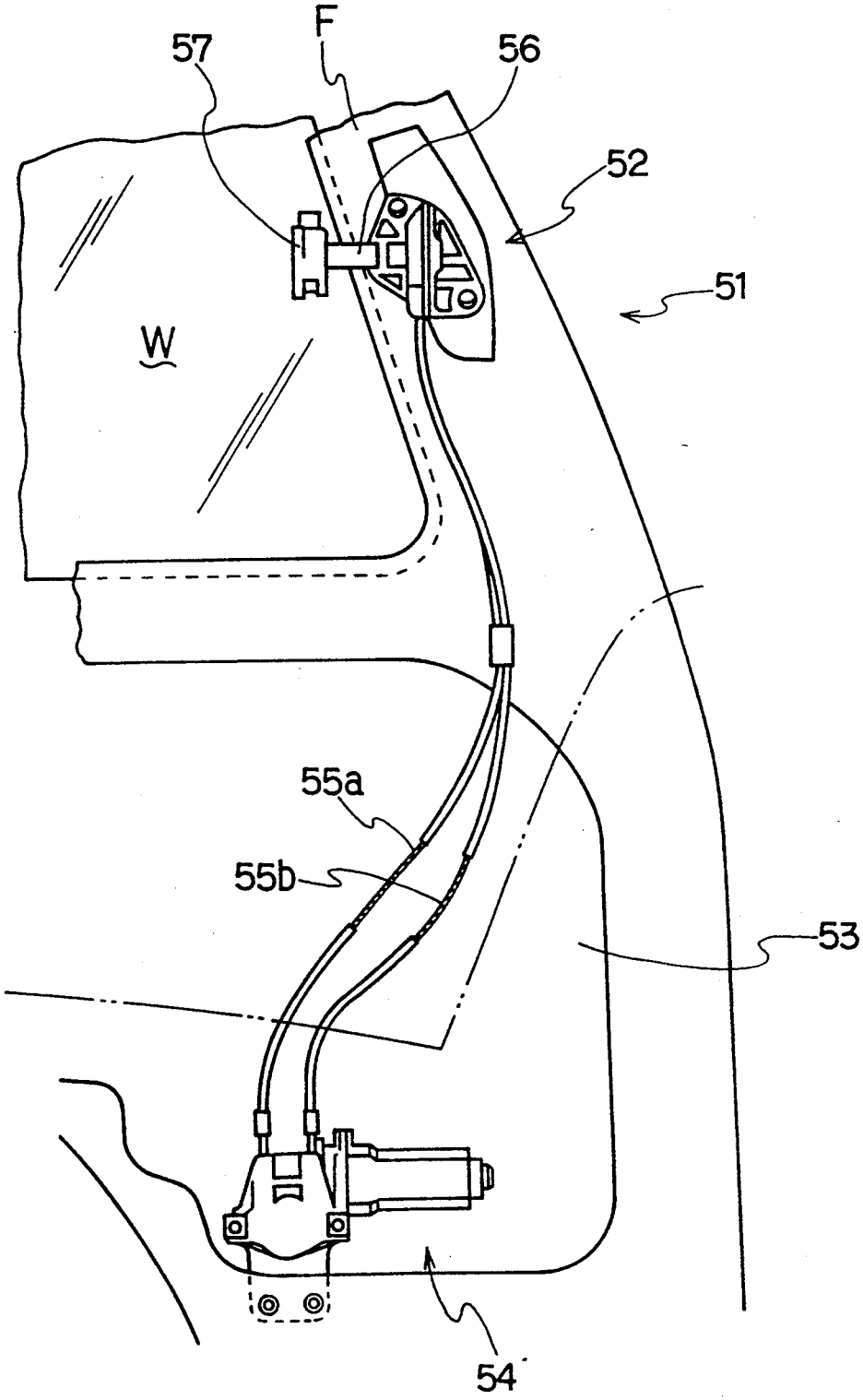
FIG. 7 PRIOR ART
FIG. 7 is an illustrative view of an embodiment of a conventional window opener.

The operation of the link mechanism is shown in FIGS. 5 to 6. FIG. 5 shows the state that the window W is closed and FIG. 6 shows the state that the window W is opened. When the shaft 3 is rotated in the direction of arrow A (With reference to FIG. 6), the first link 21 rotates in the direction of arrow A1 and the second link 22 is caused to rotate in the direction of arrow A2. Thus, the window W is opened. At this time, the shaft 3 is rotated in the direction of arrow B (with reference to FIG. 6), the first link 21 rotates in the direction of arrow B1 and the second link 22 is pulled back in the direction of arrow B2. Then, the window is closed (the state shown in FIG. 5).

In the state shown in FIG. 5, the boss 24 of the first link 21 is coming into contact with the rib 26 of the second link 22. Therefore, the first link 21 does not rotate.

A connecting point 27 wherein the first link 21 is connected with the second link 22 is located under a line L extending from the center of the shaft 3 to the center of the ball joint 25. Accordingly, the link 21 and 22 do not rotate and the window W never opens even if the window W is pushed by a hand and the like in the direction of opening the window.

Furthermore, the motor M is provided with a reduction device composed of the worm gear and the like. Therefore, the window cannot be opened from the side of the window W.

In the state that the window W is opened (with reference to FIG. 6), the window W is stopped by contacting the tip portion of the first link 21 with the periphery of the rib 26 of the second link 22.

Since the above connecting point 27 is located under the line L, a locking effect is created.

In the embodiment shown, a circuit breaker 28 is incorporated as shown in FIG. 2 to 3. Therefore, if the opener 1 is constrained by an external force, then the circuit breaker 28 is operated by an excess current and the motor M is prevented from buring by breaking the current to the motor M.

In the Figure numeral 29 denotes a connector for connection to power source.

A switch for clockwise or counterclockwise operation of the motor M can be provided at any portion in the cabin of an automobile via an electric wire. Therefore, the motor M can be operated from a driver's seat or the rear seat S.

The opener of the present invention is not limited to the above embodiment and can be used in the open-and-close operation of several kinds of windows such as a sun roof of the automobile or a window of a construction.

In the present invention, since a rigid rod or cables is not used, the number of parts is few and a motor providing a low output can be used. Therefore, it is very easy to manufacture and equip and the cost of manufacturing the opener becomes low.

Further since, the gears in the reduction device are superposed on each other, the actuating device is compactly produced. Moreover, the motor is fixed by using suitable dampers. Therefore, vibration isolation and sound isolation effects are superior and a smooth operation is obtained.

Though several embodiments of the present invention are described above, it is to understood that the present invention is not limited only to the above-mentioned, and various changes and modifications may be made in the invention without departing from the spirit and scope thereof.

What is claimed is:

1. A window opener for opening or closing a window including a window frame and a window pane rotatably set in said window frame, the window opener comprising a motor having an output shaft and contained within a casing, a damper for vibration isolation interposed between said motor and said casing, a worm concentrically connected to said output shaft of said motor, a worm wheel engaging said worm, a pinion concentrically projecting from said worm wheel, an output gear engaged with said pinion, an output gear shaft projecting from an upper surface of said output gear, and a link mechanism connected to said output gear shaft for transforming a rotational force of said output gear shaft in one direction into an opening force and for transforming said rotational force of said output gear shaft in another direction into a closing force of said window; said worm, said worm wheel and said output gear arranged relative to each other so as to be superposed.

2. A window opener of claim 1 which further includes a bracket having two arm portions and adjacent to an end of the output shaft of the motor, both arm portions of the bracket extending in a direction substantially perpendicular to the shaft of the motor, each of said arm portions approximately extending to inner faces of said casing which are opposed to each other; the window opener also including first dampers on tip portions of said arm portion of said bracket which contact with the inner faces of said casing; second dampers having a plate-like-shape, each of the second dampers interposed between said motor and one of the inner faces of the casing defining a floor and a ceiling thereof; and a third damper comprising a pair of flat springs integrated in the casing such that one of the pair contacts a tip portion of said worm and one of the pair contacts a back side of said motor.

3. A window opener of claim 1 wherein said output gear includes a circular groove formed around a periphery of a reverse side of said output gear and said casing has a floor and includes partially cylindrical protrusion projecting from said floor of the casing, said protrusion engaging with said circular groove; and wherein said worm has a tip portion extending to about the center of the reverse side of said output gear.

4. A window opener of claim 1 wherein the motor is an electric motor connected to a source of electric current and said window opener further includes a circuit breaker for preventing the motor from burning by breaking the electric current to the motor when said window opener is constrained by an external force.

* * * * *